US006454017B1

(12) United States Patent
Fischer et al.

(10) Patent No.: US 6,454,017 B1
(45) Date of Patent: Sep. 24, 2002

(54) UPRIGHT FIRE PROTECTION NOZZLE

(75) Inventors: Michael A. Fischer, West Kingston; David J. LeBlanc, Smithfield, both of RI (US)

(73) Assignee: Grinnell Corporation, Cranston, RI (US)

( * ) Notice: Subject to any disclaimer, the term of this patent is extended or adjusted under 35 U.S.C. 154(b) by 0 days.

(21) Appl. No.: 09/603,686

(22) Filed: Jun. 26, 2000

(51) Int. Cl.[7] ..... A62C 37/08

(52) U.S. Cl. ..... 169/37; 169/38; 169/39; 169/40; 169/41

(58) Field of Search ..... 169/37, 38, 42, 169/16, 17, 39–41, 498, 504, 518, 523

(56) References Cited

U.S. PATENT DOCUMENTS

| | | | | |
|---|---|---|---|---|
| 2,361,144 A | | 10/1944 | Loepsinger | |
| 2,378,273 A | | 6/1945 | Wilhelm | |
| 2,862,565 A | | 12/1958 | Dukes | |
| 4,113,021 A | * | 9/1978 | Werner | 169/37 |
| 4,136,740 A | * | 1/1979 | Groos et al. | 169/39 |
| 4,405,018 A | | 9/1983 | Fischer | |
| 4,569,485 A | | 2/1986 | Walto | |
| 5,392,993 A | | 2/1995 | Fischer | |
| 5,505,383 A | | 4/1996 | Fischer | |
| 5,513,708 A | | 5/1996 | Sundholm | |
| 5,609,211 A | * | 3/1997 | Meyer et al. | 169/37 |
| 5,829,684 A | | 11/1998 | Fischer | |
| 5,839,667 A | | 11/1998 | Fischer | |
| 5,862,994 A | * | 1/1999 | Pounder et al. | 169/498 |

FOREIGN PATENT DOCUMENTS

| | | |
|---|---|---|
| EP | 0 868 928 | 10/1998 |
| FR | 2 765 112 | 12/1998 |

OTHER PUBLICATIONS

"Guidelines for the Approval of Fixed Water–Based Local Application Fire–Fighting Systems for Use in Category a Machinery Spaces"; Annex 10; Draft MSC Circular FP/43/18; pp. 2–10; Annex 9; pp. 1–2.

"Advances in the Technology of Intermediate Pressure Water Mist Systems for the Protection of Flammable Liquid Hazards"; Jerome S. Pepi, Grinnell Corporation; Jun. 24, 1998; pp. 1–8; Tables 1–5; Figures 1–15; Photos 1–4.

"Water Mist Fire Protection—When Less is Better"; Jerome S. Pepi; Fire Protection Products, Tyco Flow Control; Dec. 1997; pp. 1–11.

"A Review of Water Mist Fire Suppression Systems—Fundamental Studies"; Zhigang Liu and Andrew K. Kim, Institute for Research in Construction, National Research Council Canada; pp. 32–50.

"NFPA 750 Standard on Water Mist Protection Systems", 2000 Edition; Copyright 2000, NFPA; pp. 750–1–750–59.

"AquaMist® Total Compartment Deluge System, Type AM4 Aquamist® Open Nozzles, For the Proteciton of Flammable Liquid Hazards", Grinnell Corporation; Printed 6/98.

(List continued on next page.)

*Primary Examiner*—Leslie D. Morris
*Assistant Examiner*—Davis Hwu
(74) *Attorney, Agent, or Firm*—Fish & Richardson P.C.

(57) ABSTRACT

An upright-type fire protection spray mist nozzle has a base defining an orifice through which fire-retardant fluid can flow, an inlet section having an upstream end and defining a conduit for flow of fire-retardant fluid along a orifice axis and leading to an upstream end of the orifice, and a diffuser element defining an impingement surface that is at least substantially imperforate in an axial direction and positioned for impingement by a stream of fire-retardant fluid flowing from the orifice in a stream direction along the orifice axis, the diffuser element being positioned generally above a horizontal plane through a downstream end of the orifice.

23 Claims, 8 Drawing Sheets

OTHER PUBLICATIONS

"Appendix A" to Fire Council of Underwriters Laboratories Inc. and Subscribers to UL's Standards Service for Automatic and Open Sprinklers; Underwriters Laboratories Inc.; Jul. 22, 1994; Subject 2167; pp. A1–A75; "Appendix B", Jul. 22, 1994; p. B1.

Viking® Technical Data: "High Challenge® Large Drop Sprinklers" (Jan. 1987), pp. 113–114.

Viking® Technical Data: "High Challenge® Large Drop Sprinklers" (Mar. 21, 1996), pp. 113a–113b.

Top view, High Challenge® Large Drop Sprinkler, by The Viking Corp., bearing 1979 date code and "U.S. Patent No. 4,136,740" on outer deflector surface, 1p.

Viking High–Challange® Sprinklers, Application Report: Digital Equipment Corporation (May 1986), 4pp.

"Record The Magazine of Property Conservation", Factory Mutual System (May–Jun. 1978), p. 13.

"Request for Comments on the Proposed First Edition of the Standard for Water Mist Nozzles for Fire Protection Service, UL 2167", Underwriters' Laboratories Inc. (Aug. 1, 1998), 78pp.

"Fire Protection—Automatic Sprinkler Systems—6182 Part 9—Requirements and Test Methods for Water Mist Nozzles" (ISO/CD 6182–9:2000 (Rev. 2)) [Draft], ISO (International Standards Organization) Committee (Dec. 8, 2000), 15pp.

International Search Report; PCT/US01/41132; Jan. 31, 2002; R. Ottesen.

* cited by examiner

UPRIGHT FIRE PROTECTION NOZZLE

TECHNICAL FIELD

This invention relates to water spray sprinklers and nozzles for fire protection service, and, in particular, to those nozzles in which a single stream of water is discharged and impacts or impinges against a downstream element as a means of deflecting, spreading or diffusing the discharge stream into a spray pattern consisting of individual droplets.

BACKGROUND

Water sprays consisting of relatively small water droplets have been shown to be among the most efficient fire extinguishing media currently available. Small water droplets suspended in the atmosphere can be forcibly injected or entrained through the convective currents, into the combustion region of a fire, where they quickly evaporate. The evaporation of these droplets has an impact upon the combustion process by absorbing some quantity of the energy output of the fire, and by displacing gaseous oxidizing agents. At some critical point, then the fire is no longer capable of self-sustained combustion, it is extinguished. It has been shown that droplets of less than 50 microns in size are extremely efficient fire extinguishing agents. As droplet size increases, the efficiency of the fire extinguishing media, typically water, decreases, although it has been demonstrated that water sprays with the majority of the droplets between 50 and 250 microns in size can be highly effective and efficient fire extinguishing agents, particularly when delivered in a componentized spray pattern. Fischer U.S. Pat. No. 5,839,667 teaches that it can be desirable to selectively provide areas of higher water discharge per unit area, greater droplet size, and/or greater droplet momentum. It has also been shown that different expected fire scenarios may require different spray pattern characteristics, if the effectiveness of fixed fire fighting system is to be maximized.

The main types of water mist nozzles for fire protection include diffuser impingement nozzles, pressure jet nozzles, and gas atomizing nozzles. Diffuser impingement nozzles operate by impacting a coherent water stream against a diffuser. The diffuser breaks the stream into a predetermined distribution of mist. Diffuser impingement-type water mist nozzles are described in Fischer U.S. Pat. No. 5,392,993 and in Fischer U.S. Pat. No. 5,505,383. Pressure jet nozzles function by discharging high velocity water streams through small orifices with an internal shape, e.g., a scroll-type arrangement is typical, designed to break up the water stream. A pressure jet type water mist nozzle is described in Sundholm U.S. Pat. No. 5,513,709. Gas-atomizing water mist nozzles operate by mixing compressed gas with water in a mixing chamber at the nozzle discharge orifice. A gas atomizing water mist nozzle is described in Loepsinger U.S. Pat. No. 2,361,144.

The spray pattern characteristics produced by existing diffuser elements utilized in impingement-type water mist nozzles fall into two distinct categories. The first category is a relatively uniformly filled, umbrella-shaped cone of spray extending from the discharge nozzle. The second category is a largely hollow cone, with the spray pattern forming a uniform or nonuniform shell of spray. Fischer U.S. Pat. No. 5,829,684 describes a nozzle producing a combination of these two fundamental types, with a uniform, umbrella-shaped shell superimposed over a relatively uniformly filled inner cone.

SUMMARY

According to one aspect of the invention, an upright-type fire protection spray mist nozzle comprises a base defining an orifice, with an orifice axis, through which fire-retardant fluid can flow, an inlet section having an upstream end and defining a conduit for flow of fire-retardant fluid along the orifice axis and leading to an upstream end of the orifice, and a diffuser element positioned coaxially downstream of the orifice, the diffuser element defining an impingement surface that is at least substantially imperforate in the axial direction and positioned for impingement by a stream of fire-retardant fluid flowing from the orifice in a stream direction along the orifice axis. The impingement surface comprises a central conical shape surface region extending generally toward the orifice, with an apex portion disposed along the orifice axis, a peripheral edge disposed generally radially outward from the conical shape surface region, and a concave, toroidal surface region generally between the conical shape surface region and the peripheral edge.

Preferred embodiments of this aspect of the invention may include one or more of the following additional features. The apex and the peripheral edge are disposed in a plane generally perpendicular to the orifice axis. Preferably, at least a portion of the toroidal surface region is recessed downstream from the plane of the apex and the peripheral edge, relative to the orifice. More preferably, the toroidal surface region is recessed downstream from the plane of the apex and the peripheral edge, relative to the orifice. The stream of fire retardant fluid flowing from the orifice to impinge upon the impingement surface is substantially steady and coherent. The concave, toroidal surface region has a shape formed by rotation of an ellipse having a major diameter greater than the radius of the peripheral edge of the impingement surface, rotated about a line defined by the orifice axis passing through the apex. The impingement surface defines at least one surface discontinuity in a region of the peripheral edge for redirecting a portion of the flow of fire retardant fluid along the impingement surface. Preferably, the impingement surface defines a set of surface discontinuities spaced circumferentially about the orifice axis in the region of the peripheral edge for redirecting a portion of the flow of fire retardant fluid along the impingement surface. More preferably, redirecting a portion of the flow of fire retardant fluid by the set of surface discontinuities divides the flow into multiple segments at the peripheral edge with little loss of energy. The surface discontinuity has the form of a notch in the impingement surface. Preferably, the notch defines a surface region extending to the peripheral edge in a plane generally tangent to a base region of the concave surface and lying generally perpendicular to the orifice axis. The stream has a diameter, and the ratio of the diameter of a region of the concave surface lying generally tangent to a plane that is generally perpendicular to the orifice axis and the diameter of the stream of fire retardant fluid flowing from the orifice and intersecting the impingement surface is greater than or equal to 2. The upright-type fire protection spray mist nozzle may be in the form of an open nozzle for use in deluge-type fire protection systems, or, alternatively, may be in the form of an automatically-operating nozzle comprising, in a standby condition, a releasable orifice seal secured in position by a thermally-responsive element.

According to another aspect of the invention, an upright-type fire protection spray mist nozzle comprises a base defining an orifice, with an orifice axis, through which fire-retardant fluid can flow, an inlet section having an upstream end and defining a conduit for flow of fire-retardant fluid along the orifice axis and leading to an upstream end of the orifice, and a diffuser element positioned coaxially downstream of the orifice, the diffuser element defining an impingement surface that is at least substantially imperforate in the axial direction and positioned for impingement by a stream of fire-retardant fluid flowing from the orifice in a stream direction along the orifice axis. The impingement surface is shaped to divert fire-retardant fluid in the stream to flow from the orifice axis radially outward, along the impingement surface, toward a peripheral edge of the impingement surface, the impingement surface adapted to substantially redirect the flow of fire-retardant fluid from the stream by at least 90° from the stream direction while maintaining the flow of fire-retardant fluid toward the peripheral edge substantially in contact with the impingement surface in a manner to substantially avoid splashing.

Preferred embodiments of this aspect of the invention may include the following additional feature. The impingement surface is adapted to redirect the flow of fire-retardant fluid by at least 110° from the stream direction while maintaining the flow of fire-retardant fluid toward the peripheral edge substantially in contact with the impingement surface in a manner to substantially avoid splashing.

According to still another aspect of the invention, an upright-type fire protection spray mist nozzle comprises a base defining an orifice, with an orifice axis, through which fire-retardant fluid can flow, an inlet section having an upstream end and defining a conduit for flow of fire-retardant fluid along the orifice axis and leading to an upstream end of the orifice, and a diffuser element positioned coaxially downstream of the orifice. The diffuser element defines an impingement surface that is at least substantially imperforate in the axial direction and positioned for impingement by a stream of fire-retardant fluid flowing from the orifice in a stream direction along the orifice axis, the impingement surface comprising a central conical shape surface region extending generally toward the orifice, with an apex portion disposed along the orifice axis, a peripheral edge disposed generally radially outward from the conical shape surface region, and a concave, toroidal surface region generally between the conical shape surface region and the peripheral edge, the impingement surface being shaped to divert the fire-retardant fluid in the stream to flow from the orifice axis radially outward, along the impingement surface, towards the peripheral edge of the impingement surface, the impingement surface being adapted to redirect the flow of fire-retardant fluid from the stream by at least 90° from the stream direction while maintaining the flow of fire-retardant fluid toward the peripheral edge substantially in contact with the impingement surface in a manner to substantially avoid splashing.

According to another aspect of the invention, an upright-type fire protection spray mist nozzle comprises a base defining an orifice, with an orifice axis, through which fire-retardant fluid can flow, an inlet section having an upstream end and defining a conduit for flow of fire-retardant fluid along the orifice axis and leading to an upstream end of the orifice, and a diffuser element defining an impingement surface that is at least substantially imperforate in an axial direction and positioned for impingement by a stream of fire-retardant fluid flowing from the orifice in a stream direction along the orifice axis, the diffuser element being positioned generally above a horizontal plane through a downstream end of the orifice.

According to another aspect of the invention, an upright-type fire protection spray mist nozzle discharges a spray of fire-retardant fluid over an area to be protected from fire, the spray being characterized by a $Dv_{90}$ droplet size diameter of less than about 250 microns, preferably less than about 200 microns, and more preferably less than about 150 microns, when measured at a pressure of a 175 psi at the inlet to the nozzle, in accordance with the procedure recommended in the 2000 edition of the NFPA 750 Standard on Water Mist Fire Protection Systems (also see Section 1-4.5 for the definition of "$Dv_{90}$ droplet size diameter").

According to still another aspect of the invention, an upright-type fire protection spray mist nozzle comprises a base defining an orifice, with an orifice axis, through which fire-retardant fluid can flow; and an inlet section having an upstream end and defining a conduit for flow of fire-retardant fluid along the orifice axis and leading to an upstream end of the orifice. A diffuser element defines all impingement surface that is at least substantially imperforate in the axial direction and positioned for impingement by a stream of fire-retardant fluid flowing from the orifice in a stream direction along the orifice axis, the diffuser element being positioned generally above a horizontal plane through a downstream end of orifice, and the orifice has an orifice diameter preferably less than about 0.200 inch, and more preferably less than about 0.150 inch, and still more preferably less than 0.100 inch.

The invention provides, in its broadest aspect, an upright-type fire protection spray mist nozzle, and further provides a diffuser for an impingement-type nozzle having a solid (i.e., at least substantially imperforate in an axial direction), three-dimensional surface shaped to receive and redirect a coherent fluid stream impinged thereupon with substantially no splashing, even when the primary axis of the fluid stream at impact is essentially completely opposed by the impingement surface. Furthermore, surface discontinuities defined by the impingement surface discretely divide the impinging fluid stream into multiple segments with little energy loss, even at low velocities, and selected segments can essentially reversed in direction with respect to the initial stream flow direction from the nozzle outlet. Additionally, the resulting spray pattern discharge consists of water droplets that appear to be substantially smaller than those typically associated with impingement-type diffusers, even those with smaller orifices. For example, with a fluid (water) pressure of about 175 psi at the inlet section of the mist nozzle of this invention having an orifice diameter of about 0.130 inch, the nozzle discharges a spray with a $Dv_{90}$ droplet size diameter of less than 200 microns, as compared to a $Dv_{90}$ droplet size diameter of the order of 300 microns for the Grinnell Type AM4 AquaMist® pendent-type nozzle having a nominal orifice diameter of 0.091 inch, as described in Grinnell Technical Data Sheet TD1173, when measured in accordance with the procedure recommended in the 2000 Edition of the NFPA 750 Standard on Water Mist Fire Protection Systems.

The required spray pattern characteristics of mist nozzles, including droplet size and droplet count density, for use in fixed spray fire fighting systems are determined by the expected fire scenario. Of particular interest is redirection of a majority of the discharged water downstream of the impingement surface of the diffuser in a direction nominally opposite to the direction of bulk flow of the water stream, upstream of the impingement surface of the diffuser, while maintaining relatively small droplet size within the nozzle spray pattern. The attribute of maintaining small droplet size while reversing the bulk average direction of the fluid flow allows spray pattern characteristics not previously achieved using existing technology.

The present invention provides a nozzle that can be employed to distribute a water mist discharge pattern that is discretely adjustable, allowing predetermined positioning of a multitude of areas of high and low water discharge density as deemed preferable for an expected fire scenario. The result is an improvement in performance over existing impingement-type water mist diffusers.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
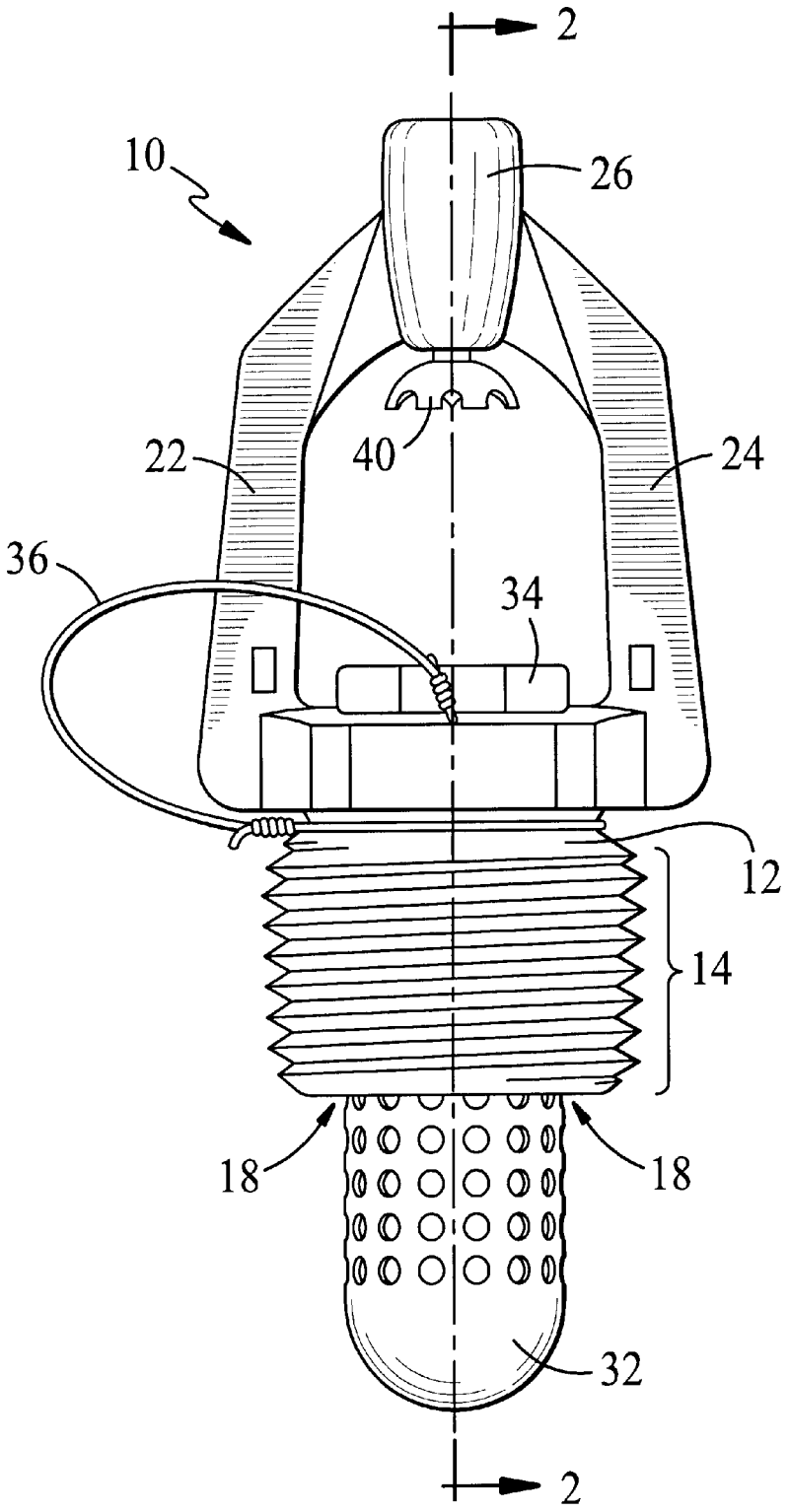
FIG. 1 is a front elevational view of an upright fire protection spray mist nozzle of the invention.
Figure 2:
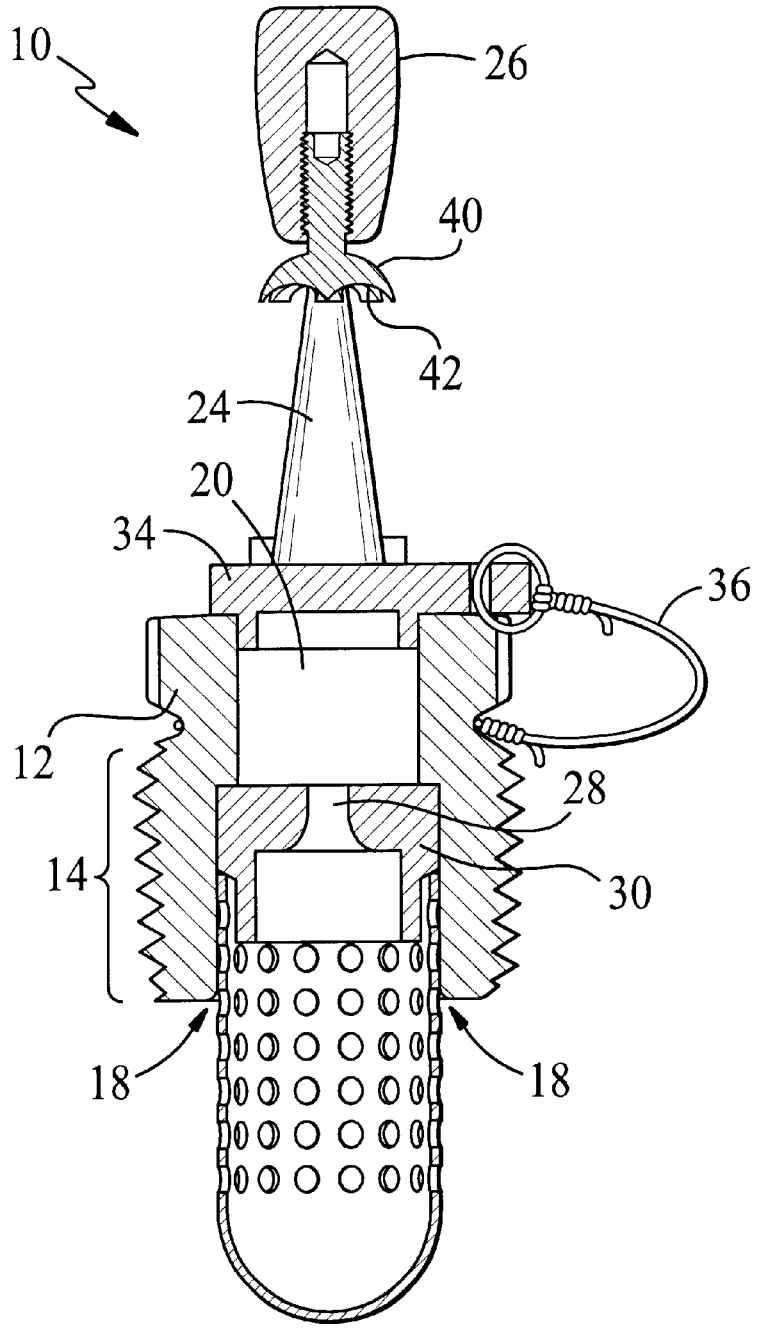
FIG. 2 is side elevational view, taken in section, of the upright fire spray mist nozzle of FIG. 1.

Referring to FIGS. 1 and 2, an upright-type fire spray mist nozzle 10 of the invention has a base 12 defining external threads 14 for threaded, sealed connection to a fire retardant fluid supply system (not shown). The base 12 defines a through passageway 16 extending generally along axis, A, for flow of fire retardant fluid from the inlet 18 (in communication with the fluid supply system) to the outlet 20, exterior of the base. In a region downstream of the outlet, arms 22, 24 extend from the base 12 to an apex 26, positioned downstream of, and coaxial with, an orifice 28 defined by an orifice insert 30 and continuous with passageway 16 of the base 12, e.g. in much the same way as in traditional nozzles typically used for fire protection system service.

Figure 3:
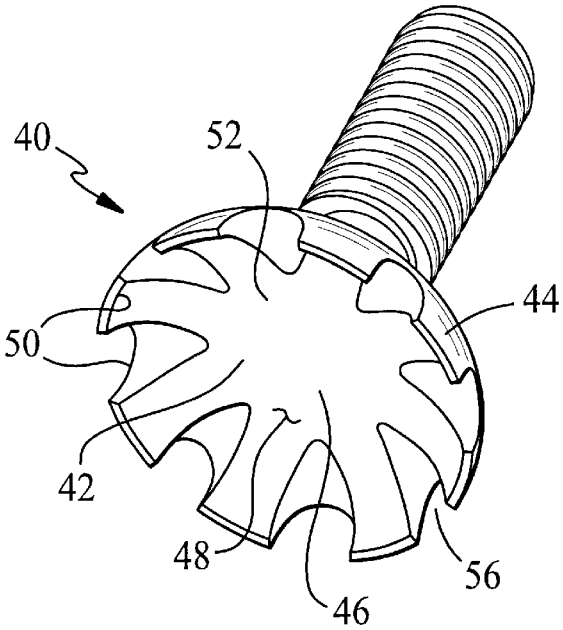
FIG. 3 is an enlarged perspective view of the diffuser element of the upright fire protection spray mist nozzle of FIG. 1.
Figure 4:
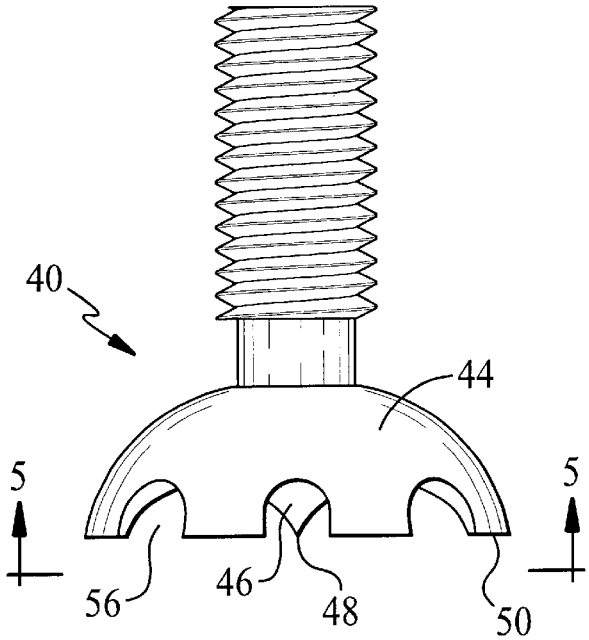
FIG. 4 is an enlarged front elevational view of the diffuser element of the upright fire protection spray mist nozzle of FIG. 1
Figure 5:
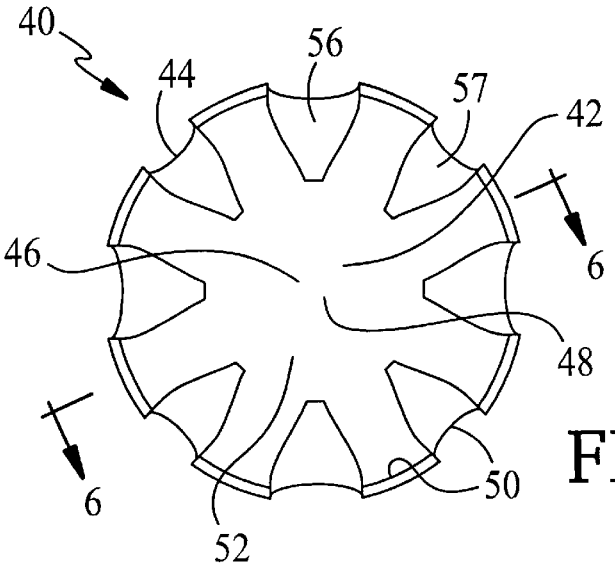
FIG. 5 is bottom elevational view, taken at the line 5—5 of FIG. 4, of the diffuser element of the upright fire spray mist nozzle of FIG. 1.

A strainer 32 positioned across the inlet 18 to passageway 16 protects orifice 28 in orifice insert 30 from clogging, e.g., due to debris in the fluid supply system. Under standby conditions, an elastomeric plug 34 seals the outlet 20 from airborne debris, insects and the like that might tend to clog the orifice. A flexible lead 36, e.g. of metal or plastic, attaches the plug 34 to the base 12 of the nozzle so that the plug will not be blown away from the nozzle upon discharge of fluid from the nozzle outlet (FIGS. 7 and 8), Referring now also to FIGS. 3, 4 and 5, in the fire protection nozzle 10 of the invention, a diffuser 40 defining a solid (i.e., at least substantially imperforate in the axial direction) impingement surface 42 opposed to flow of fire retardant fluid from the orifice 28 is mounted to the apex 26, in threaded engagement therewith, to allow adjustment of the spacing of the impingement surface 42 from the orifice 28 and to allow rotational positioning of discontinuities (notches) 56 defined in the peripheral edge 50.

Figure 6:
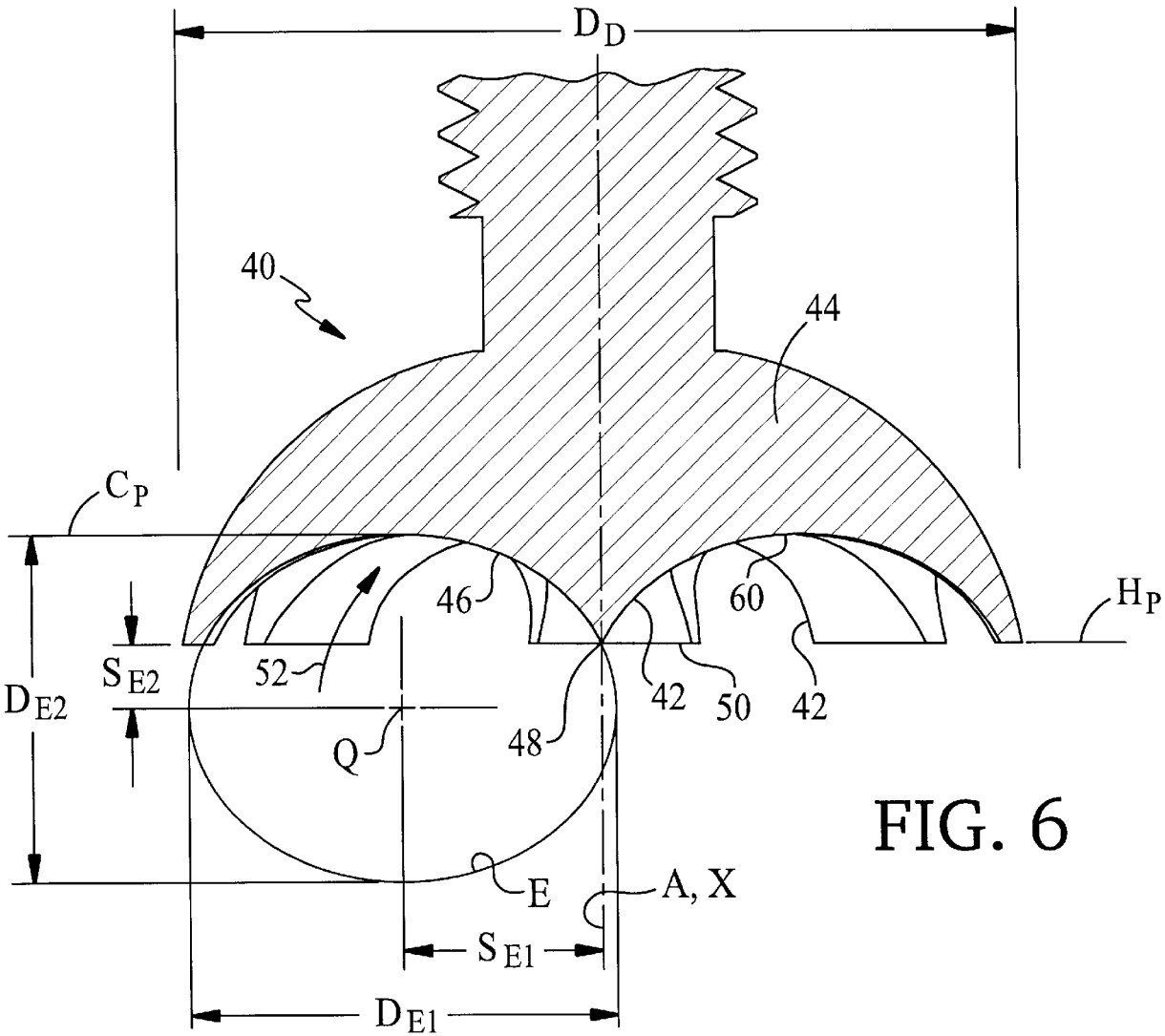
FIG. 6 is a further enlarged side elevational view, taken at the line 6—6 of FIG. 5, of the diffuser element of the upright fire spray mist nozzle of FIG. 1.

Referring also to FIG. 6, the impingement surface 42 of the diffuser 40 for redirecting the water flow from the orifice 28 of the nozzle outlet 20 is preferably defined by a solid, hemispherical shaped body 44, formed, e.g., by machining, sintering, investment casting or other suitable process, of brass, or other suitable material. The impingement surface includes a protruding, generally conical shape surface region 46 with an apex 48 centered generally on axis, A, and extending relatively toward the orifice 28. Surrounding the conical shape region 46, inward from the peripheral edge 50 of the impingement surface 42, is a toroidal, concave surface region 52, which is recessed, relative to the orifice 28, from the a plane, $H_P$, of the apex 48 and peripheral edge 50. In a preferred embodiment, the shape of the concave region 52 is defined by rotating an ellipse, E, around axis, A, of the hemispherical shaped body 44. In a preferred embodiment, the ellipse, E, has major diameter, $D_{E1}$, larger than the radius of the peripheral edge 50 of the hemispherical shaped body 44, and a minor diameter, $D_{E2}$, with a center point, Q, spaced from axis, A, by a distance, $S_{E1}$, and spaced from the plane, $H_P$, by a distance, $S_{E2}$. By way of example, for a diffuser 40 of the invention having a diameter, $D_D$, of 0.5 inch, the ellipse major diameter, $D_{E1}$, is about 0.255 inch, the minor diameter, $D_{E2}$, is about 0.207 inch, the distance, $S_{E1}$, is about 0.119 inch, and the distance, $S_{E2}$, is about 0.043 inch. Preferably, the impingement surface 42 defines a set of discontinuities formed in the region of the outer peripheral edge, with the number, size and shape of the discontinuities determining the precise spray discharge pattern. For example, in the diffuser 40 shown in FIGS. 3–6, the discontinuities have the form of a set of notch surfaces 56, e.g., eight notches are shown, with the notch surfaces 56 having base regions 57 lying generally tangent to a plane, $C_P$, tangent to the base surface 60 of the concave surface region 52 and extending through the peripheral edge region 50 of the impingement surface 40 and generally parallel to the face plane, $H_P$.

Figure 7:
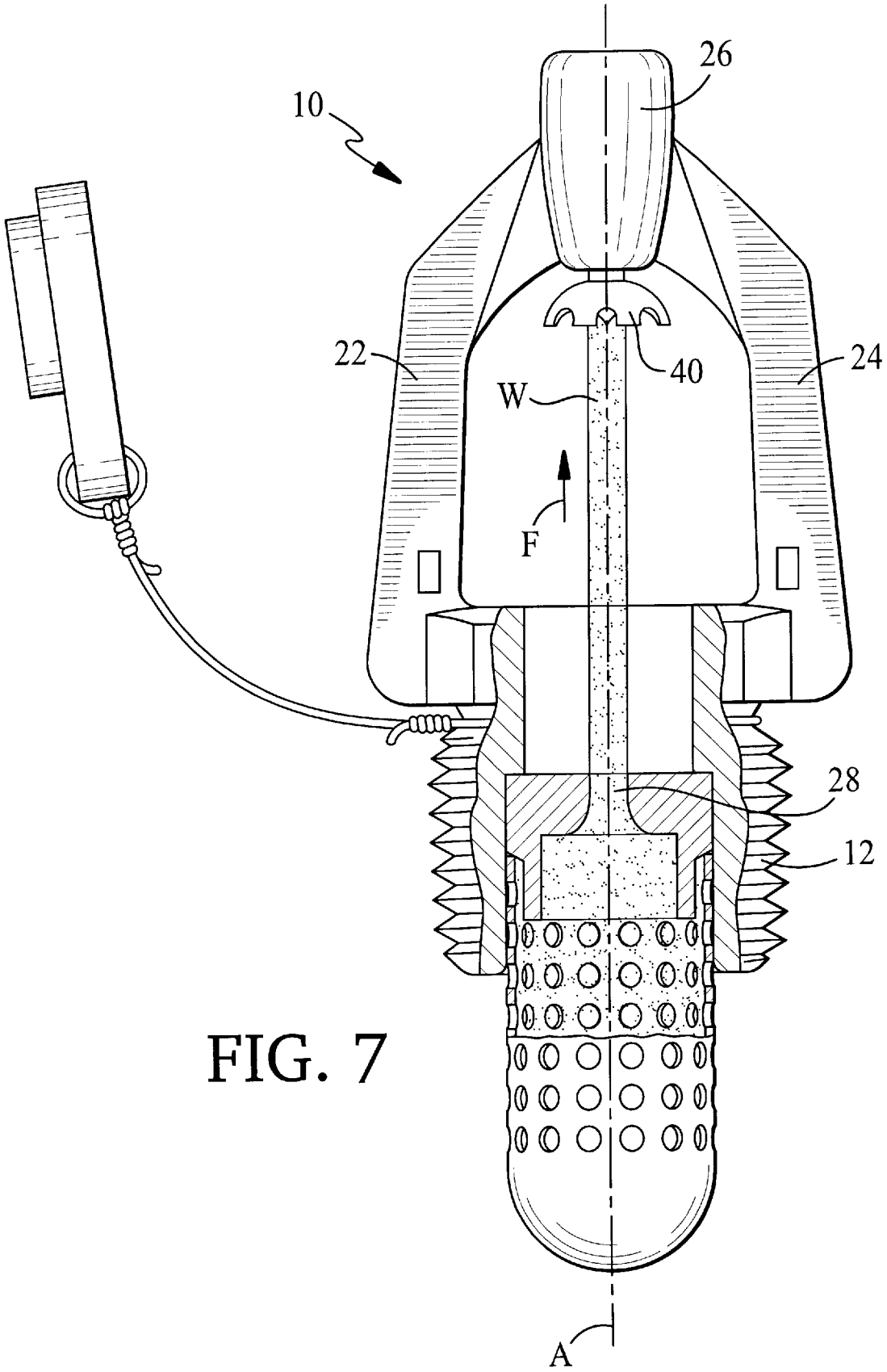
FIGS. 7 and 8 are somewhat diagrammatic, enlarged front and side views, respectively, both taken in section, of the upright fire spray mist nozzle of the invention.
Figure 8:
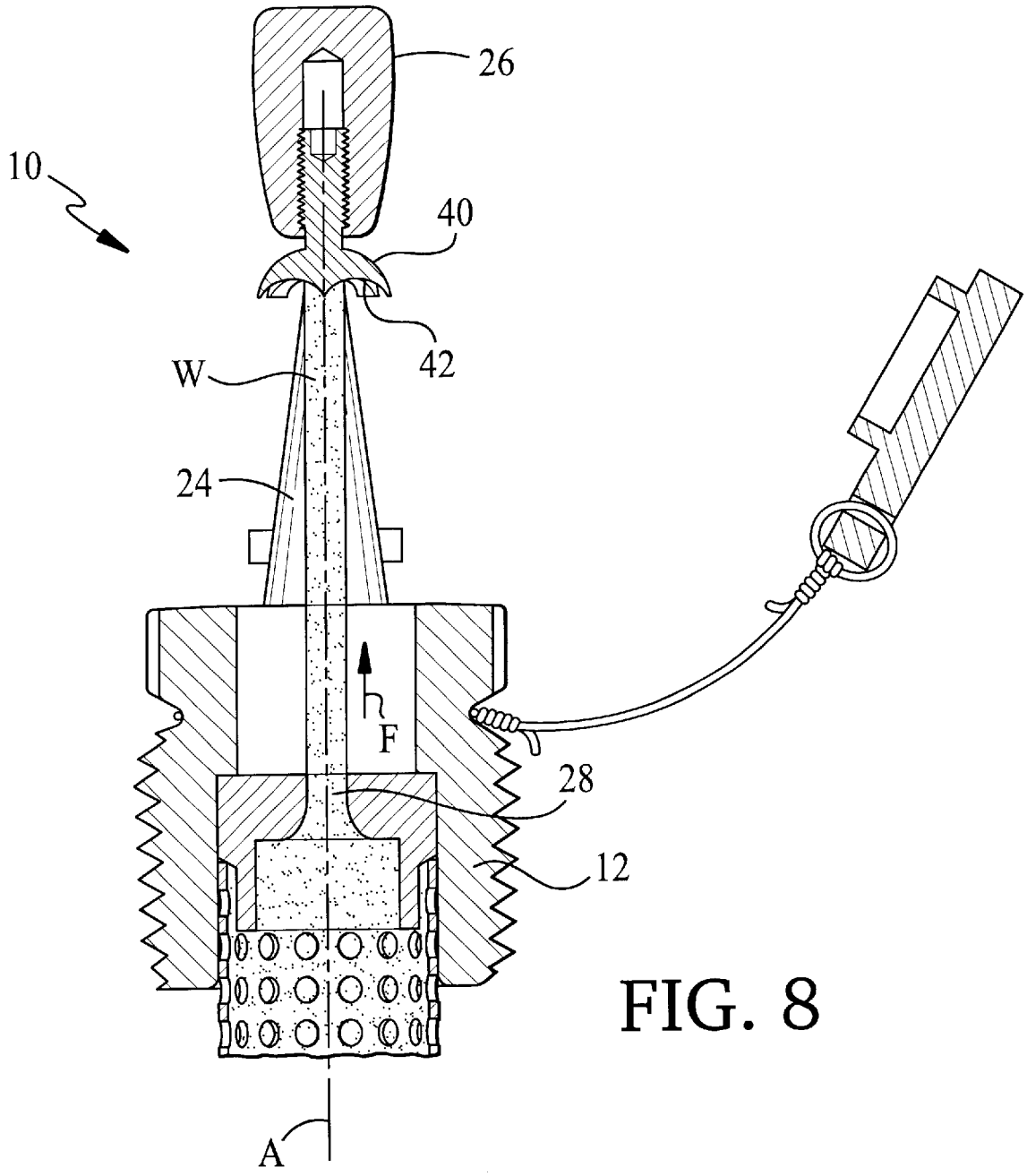
Figure 9:
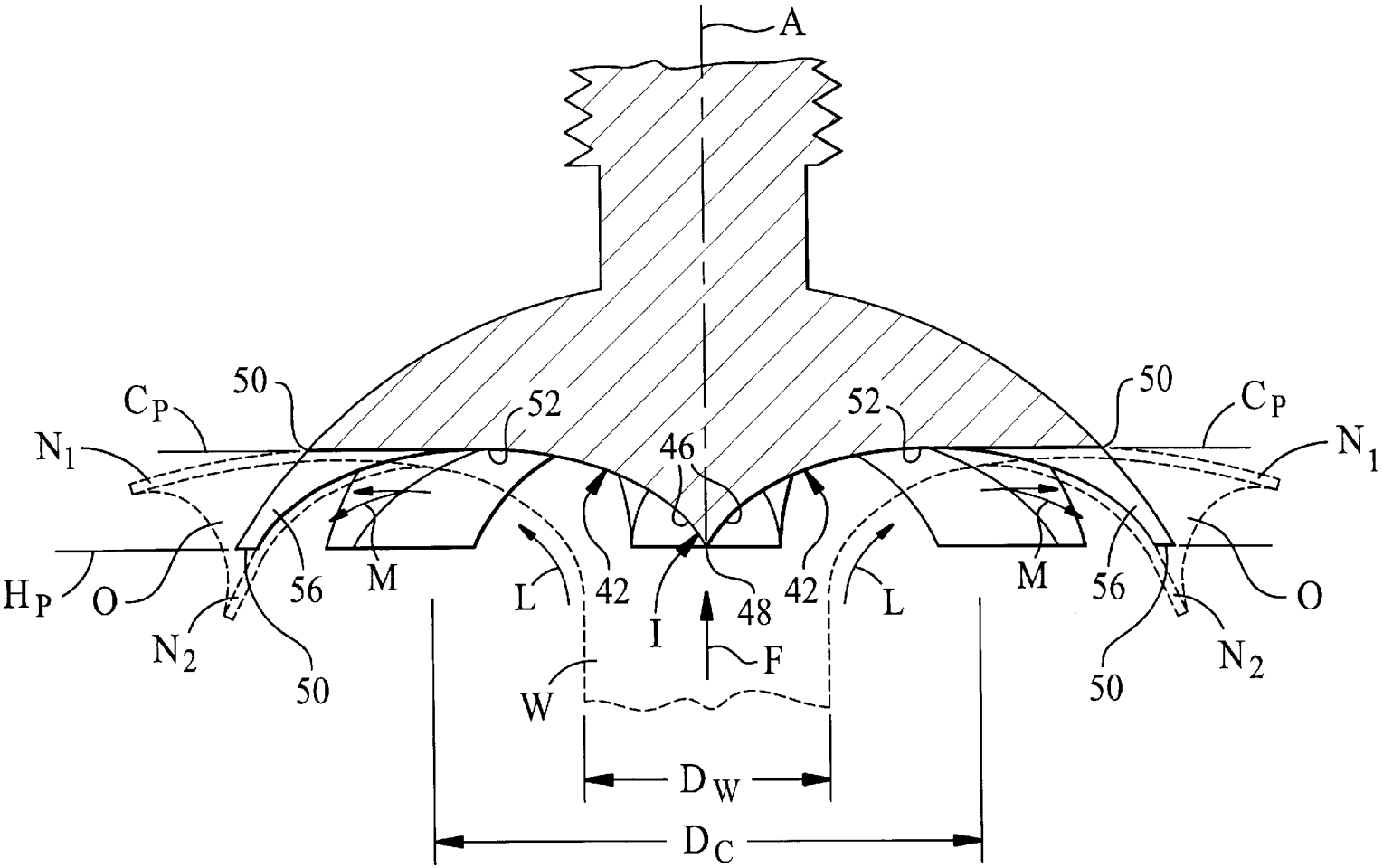
FIG. 9 is a somewhat diagrammatic front elevational view, also taken in section, of the diffuser element, all showing fluid flowing from the orifice onto the diffuser element surface, where it is redirected by more than 90° substantially without splash, by remaining generally in contact with the diffuser surface until reaching its peripheral edge.

Referring to FIGS. 7 and 8, and, in particular, FIG. 9, the bulk (stream) direction of the water flow (arrow, F) striking upon the impingement surface 42 at the apex 48 initially remains predominantly in the same direction as the water stream, W. Thereafter, as the water flows over the conical surface 46 and then relatively outward from the orifice axis, A, over the impingement surface 42, the depth or local thickness of the water is decreased. The bulk flow direction of water flowing radially outward (relative to the orifice axis, A) over the impingement surface 42 is gradually turned (arrow, L) and then reversed (arrow, M) relative to the direction of the impacting water stream (arrow, F) as the fluid passes from the initial point of impingement, I, upon the apex 48 of the impingement surface 42 and traverses over the concave inner surface region 52, toward the outer, peripheral edge 50. The resulting thinning layer of water is then broken into discrete segments $N_1$, $N_2$ (interconnected, at least initially, by water sheet, O, therebetween) to provide a predetermined droplet distribution pattern by the placement of protruding obstructions or discontinuities, such as slots 56, ridges, passageways, and the like, upon the impingement surface 42. The condition of the discharge stream, W, impinging on the impingement surface 42 of the diffuser 40 is preferably a steady, well-defined, pencil-like stream, free from excessive expansion, turbulences, and distortions. The orifice geometry attributes that produce such a discharge stream have previously been described in Fischer U.S. Pat. No. 5,392,993 and in Fischer U.S. Pat. No. 5,505,383, the complete disclosures of which are incorporated herein by reference. A steady, coherent discharge stream, W, produces a relatively more stable, uniform spray pattern from the impingement surface 42 of the diffuser 40, while a discharge stream that is unstable or distorted can typically result in a less stable or skewed spray pattern. It is noted also that the initial direction of fluid flow (arrow, F) from the discharge orifice 28 of the nozzle of the invention is oriented away from the object to be protected, with the impingement surface 42 of the diffuser 40 of the invention reversing the direction of flow so that the fire-fighting agent is discharged back towards the hazard area. In preferred embodiments of the invention, the impingement surface 42 of the diffuser 40 redirects the water flow from the discharge orifice while minimizing the introduction of turbulence prior to water stream breakup. This is preferable, as the introduction of turbulence tends to reduce the efficiency of the water droplet generation, resulting in an increase in mean droplet diameter and ultimately a decrease in fire fighting efficiency and effectiveness. A diffuser that does not cause the water to splash is inherently more efficient because the energy otherwise lost to splashing is instead used either to obtain a reduction in droplet size or to maximize droplet momentum. Also, as the diameter of the impingement stream is expanded and the resulting depth as it flows radially outward over the impingement surface is decreased, the water sheet becomes thinner, and it is apparent that the thinner the water sheet achieved prior to break-up, the smaller the droplets that will be formed upon break-up.

Referring again to FIG. 9, the operation of the diffuser element of the invention, as it is presently understood, will now be described. The water stream, W, from the discharge orifice 28 impinges upon the impingement surface 42 of the diffuser 40 at the apex 48 of the generally conical shape surface 46 generally centered on axis, A, and extending relatively toward the orifice 28. The bulk direction of the water flow stream striking the impingement surface 42 initially remains predominantly in the same direction as the water stream. However, as the water flows over the conical shape surface 46 (arrow, L), the increasing diameter of the conical surface towards its base reduces the depth or local thickness of the water flowing relatively outward from the orifice axis, A, over the impingement surface 42. The bulk flow direction of water flowing over the impingement surface 42 is gradually turned radially outward (arrow, L), relative to the orifice axis, A, and then reversed (arrow, M), relative to the direction (arrow, F) of the impacting water stream as the fluid passes from the initial point of impingement (apex 48) upon the impingement surface 42 and traverses over the concave inner surface region 52, toward the outer, peripheral edge 50. The resulting layer of water, as it is thinned, stretches until the surface tension is overcome and droplets are formed, to be delivered in a predetermined droplet distribution pattern by the placement of discontinuities, such as notches 56 (as shown), slots, ridges, passageways, and other protruding obstructions or discontinuities upon the impingement surface 42.

In preferred embodiments, the diameter, $D_C$, at which the tangent plane, $C_P$, of the internal concavity surface 52 is perpendicular to the bulk fluid flow direction (axis, A, and arrow, F) divided by the diameter of the water stream, $D_W$, as it impinges upon the impingement surface 42, is equal to or greater than 2. A ratio value of less than 2 can result in the water stream splashing off the diffuser. For example, according to one preferred embodiment:

$$D_C=0.338\pm0.002$$

$$D_W=0.130$$

$$D_C/D_W=2.6\geqq2$$

This fundamental shape of the impingement surface 42 of the diffuser of the invention results in an upright-type, water spray mist nozzle 10 providing spray patterns found suitable for fire protection of Class B combustibles, particularly liquid fuels released under elevated pressure, as the spray pattern characteristics of upright-type diffusers can be substantially different from those of pendent-type diffusers. The spray pattern characteristics of upright-type diffusers of the invention can also be designed to be very similar to those of pendent-type diffusers; the fundamental shape of the upright-type diffusers of the invention provide a relatively greater degree of flexibility in designing spray patterns, e.g., as compared to pendent-type nozzle diffusers. Additionally, upright positioning permitted by the nozzle of the invention advantageously allows a preferred method of installation, as the point of origin of the spray pattern can then be placed at the greatest possible distance (i.e., above) from the protected hazard. This can be of critical importance in situations where the available clearance between surface of the hazard and adjacent surfaces is relatively small. Furthermore, with an upright-type nozzle installation, the pipe to which the fire-fighting nozzle is fitted somewhat protects the nozzle from impact damage, e.g. during placement and removal of material from the region to be protected.

Figure 10:
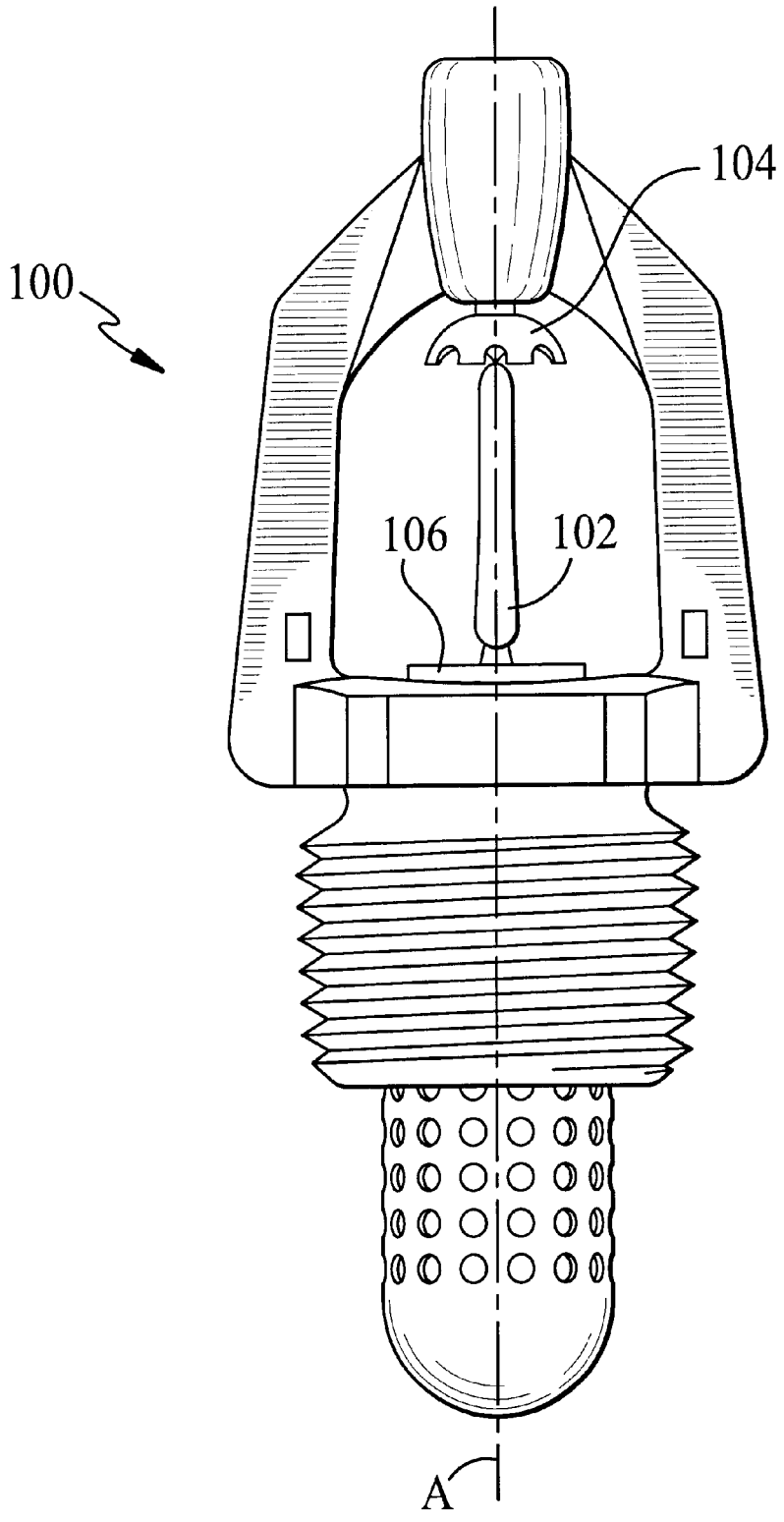
FIG. 10 is a front elevational view of another embodiment of an upright fire protection spray mist nozzle of the invention, for use in an automatic fire protection system.

A number of embodiments of the invention have been described. Nevertheless, it will be understood that various modifications may be made without departing from the spirit and scope of the invention. For example, referring to FIG. 10, in another embodiment, an upright fire protection spray mist nozzle 100 of the invention may be used in an automatically operating fire protection system, with a thermal-responsive release element 102, e.g. a glass bulb or fusible link, engaged by an axially adjustable diffuser element 104 to secure an orifice seal 106 in normal or standby condition. Also, the apex 48 of the generally conical shape surface region 46 and the peripheral edge 50 of the impingement surface 42 may be disposed in different planes, e.g. relatively closer to or more spaced from the orifice 28. The peripheral edge 50 may also have the form of a toothed surface, with the tips of the respective teeth in the same or different planes. Accordingly, other embodiments are within the scope of the following claims.

What is claimed is:

1. An upright-type fire protection spray mist nozzle, comprising:

base defining an orifice, with an orifice axis, through which fire-retardant fluid can flow;

an inlet section having an upstream end and defining a conduit for flow of fire-retardant fluid along said orifice axis and leading to an upstream end of said orifice; and a diffuser element positioned coaxially downstream of said orifice, said diffuser element defining an impingement surface that is at least substantially imperforate in an axial direction and positioned for impingement by a stream of fire-retardant fluid flowing from said orifice in a stream direction along said axis, said impingement surface having a shape and contour for generation of a spray mist and comprising:

a central conical shape surface region extending generally toward said orifice, with an apex portion disposed along said axis, a peripheral edge disposed generally radially outward from said conical shape surface region, and a concave, toroidal surface region generally between said conical shape surface region and said peripheral edge.

2. The upright-type fire protection spray mist nozzle of claim 1, wherein said apex and said peripheral edge are disposed in a plane generally perpendicular to said axis.

3. The upright-type fire protection spray mist nozzle of claim 2, wherein at least a portion of said toroidal surface region is recessed downstream from said plane of said apex and said peripheral edge, relative to said orifice.

4. The upright-type fire protection spray mist nozzle of claim 3, wherein said toroidal surface region is recessed downstream from said plane of said apex and said peripheral edge, relative to said orifice.

5. The upright-type fire protection spray mist nozzle of claim 1, wherein said stream of fire retardant fluid flowing from said orifice to impinge upon said impingement surface is substantially steady and coherent.

6. The upright-type fire protection spray mist nozzle of claim 1, wherein said concave, toroidal surface region has a shape formed by rotation of an ellipse having a major diameter greater than the radius of said peripheral edge of said impingement surface, rotated about a line defined by said orifice axis passing through said apex.

7. The upright-type fire protection spray mist nozzle of claim 1, wherein said impingement surface defines at least one surface discontinuity in a region of said peripheral edge for redirecting a portion of said flow of fire retardant fluid along said impingement surface.

8. The upright-type fire protection spray mist nozzle of claim 7, wherein said impingement surface defines a set of surface discontinuities spaced circumferentially about said axis in said region of said peripheral edge for redirecting at least a portion of said flow of fire retardant fluid along said impingement surface.

9. The upright-type fire protection spray mist nozzle of claim 8, wherein redirecting a portion of said flow of fire retardant fluid by said set of surface discontinuities divides said flow into multiple segments at said peripheral edge with little loss of energy.

10. The upright-type fire protection spray mist nozzle of claim 7, 8, or 9, wherein said surface discontinuity has the form of a notch in said impingement surface.

11. The upright-type fire protection spray mist nozzle of claim 10, wherein said notch in said impingement surface defines a surface region extending to said peripheral edge in a plane generally tangent to a base region of said concave surface and lying generally perpendicular to said axis.

12. The upright-type fire protection spray mist nozzle of claim 1, wherein said stream has a diameter and the ratio of a diameter of a region of said concave surface lying generally tangent to a plane that is generally perpendicular to said axis and said diameter of said stream of fire retardant fluid flowing from said orifice and intersecting said impingement surface is greater than or equal to 2.

13. The upright-type fire protection spray mist nozzle of claim 1, in the form of an automatically-operating fire nozzle, further comprises, in a standby condition, a releasable orifice seal secured in position by a thermally-responsive element.

14. An upright-type fire protection spray mist nozzle, comprising:

a base defining an orifice, with an orifice axis, through which fire-retardant fluid can flow;

an inlet section having an upstream end and defining a conduit for flow of fire-retardant fluid along said orifice axis and leading to an upstream end of said orifice; and a diffuser element positioned coaxially downstream of said orifice, said diffuser element defining an impingement surface that is at least substantially imperforate in an axial direction and positioned for impingement by a stream of fire-retardant fluid flowing from said orifice in a stream direction along said axis, said impingement surface having a shape and contour comprising a concave, toroidal surface region generally between a conical shape surface region and a peripheral edge of said impingement surface, to divert fire-retardant fluid in said stream to flow from said axis radially outward, along said impingement surface, toward said peripheral edge, said impingement surface adapted to substantially redirect said flow of fire-retardant fluid from said stream by at least 90° from said stream direction while maintaining said flow of fire-retardant fluid toward said peripheral edge substantially in contact with said impingement surface in a manner to substantially avoid splashing, for generation of a spray mist.

15. The upright-type fire protection spray mist nozzle of claim 14, wherein said impingement surface is adapted to redirect said flow of fire-retardant fluid by at least 110° from said stream direction while maintaining said flow of fire-retardant fluid toward said peripheral edge substantially in contact with said impingement surface in a manner to substantially avoid splashing.

16. An upright-type fire protection spray mist nozzle, comprising:

a base defining an orifice, with an orifice axis, through which fire-retardant fluid can flow;

an inlet section having an upstream end and defining a conduit for flow of fire-retardant fluid along said orifice axis and leading to an upstream end of said orifice; and a diffuser element positioned coaxially downstream of said orifice, said diffuser element defining an impingement surface having a shape and contour for generation of a spray mist and that is at least substantially imperforate in an axial direction and positioned for impingement by a stream of fire-retardant fluid flowing from said orifice in a stream direction along said axis, said impingement surface comprising a central conical shape surface region extending generally toward said orifice, with an apex portion disposed along said axis, a peripheral edge disposed generally radially outward from said conical shape surface region, and a concave, toroidal surface region generally between said conical shape surface region and said peripheral edge, said impingement surface being shaped to divert fire-retardant fluid in said stream to flow from said axis radially outward, along said impingement surface, towards a peripheral edge of said impingement surface, said impingement surface being adapted to redirect said flow of fire-retardant fluid from said stream by at least 90° from said stream direction while maintaining said flow of fire-retardant fluid toward said peripheral edge substantially in contact with said impingement surface in a manner to substantially avoid splashing, for generation of said spray mist.

17. An upright-type fire protection spray mist nozzle, comprising:

a base defining an orifice, with an orifice axis, through which fire-retardant fluid can flow;

an inlet section having an upstream end and defining a conduit for flow of fire-retardant fluid along said orifice axis and leading to an upstream end of said orifice; and a diffuser element defining an impingement surface having a shape and contour comprising a concave, toroidal surface region generally between a conical shape surface region and a peripheral edge of said impingement surface, for generation of a spray mist and that is at least substantially imperforate in an axial direction and positioned for impingement by a stream of fire-retardant fluid flowing from said orifice in a stream direction along said axis, said diffuser element being positioned generally above a horizontal plane through a downstream end of said orifice.

18. An upright-type fire protection spray mist nozzle that discharges a spray of fire-retardant fluid over an area to be protected from fire, said fire protection spray nozzle comprising a diffuser element defining an impingement surface having a shape and contour comprising a concave, toroidal surface region generally between a conical shape surface region and a peripheral edge of said impingement surface, for generation of a spray mist and that is at least substantially imperforate in an axial direction and positioned for impingement by a coherent stream of fire-retardant fluid flowing from a nozzle orifice in a stream direction along said axis, said diffuser element being positioned generally above a horizontal plane through a downstream end of said nozzle orifice, said spray mist being characterized by a $Dv_{90}$ droplet size diameter of less than about 250 microns when measured at a pressure of a 175 psi at the inlet to the nozzle, in accordance with the procedure recommended in the 2000 edition of the NFPA 750 Standard on Water Mist Fire Protection Systems.

19. The upright-type fire protection spray mist nozzle of claim 18, wherein said spray being characterized by a $Dv_{90}$ droplet size diameter of less than about 200 microns when measured at a pressure of a 175 psi at the inlet to the nozzle, in accordance with the procedure recommended in the 2000 edition of the NFPA 750 Standard on Water Mist Fire Protection Systems.

20. The upright-type fire protection spray mist nozzle of claim 19, wherein said spray being characterized by a $Dv_{90}$ droplet size diameter of less than about 150 microns when measured at a pressure of a 175 psi at the inlet to the nozzle, in accordance with the procedure recommended in the 2000 edition of the NFPA 750 Standard on Water Mist Fire Protection Systems.

21. An upright-type fire protection spray mist nozzle, comprising:

a base defining an orifice, with an orifice axis, through which fire-retardant fluid can flow;

an inlet section having an upstream end and defining a conduit for flow of fire-retardant fluid along said orifice axis and leading to an upstream end of said orifice; and a diffuser element defining an impingement surface having a shape and contour comprising a concave, toroidal surface region generally between a conical shape surface region and a peripheral edge of said impingement surface, for generation of a spray mist and that is at least substantially imperforate in an axial direction and positioned for impingement by a stream of fire-retardant fluid flowing from said orifice in a stream direction along said axis; said diffuser element being positioned generally above a horizontal plane through a downstream end of said orifice; and said orifice having an orifice diameter preferably less than about 0.200 inch.

22. The upright-type fire protection sprinkler of claim 21, wherein said orifice diameter is less than about 0.150 inch.

23. The upright-type fire protection sprinkler of claim 22, wherein said orifice diameter is less than about 0.100 inch.

* * * * *